US007906051B2

(12) United States Patent
McLain

(10) Patent No.: US 7,906,051 B2
(45) Date of Patent: Mar. 15, 2011

(54) FOAM BUFFING PAD WITH RANDOM OR STRATEGICALLY PLACED COLLAPSED CELL STRUCTURES

(75) Inventor: Scott S. McLain, Mukwonago, WI (US)

(73) Assignee: Lake County Manufacturing, Inc., Hartland, WI (US)

( * ) Notice: Subject to any disclaimer, the term of this patent is extended or adjusted under 35 U.S.C. 154(b) by 1101 days.

(21) Appl. No.: 11/621,291

(22) Filed: Jan. 9, 2007

(65) Prior Publication Data

US 2007/0254567 A1 Nov. 1, 2007

Related U.S. Application Data

(60) Provisional application No. 60/796,457, filed on May 1, 2006.

(51) Int. Cl.
*B24D 13/12* (2006.01)
*B24D 13/14* (2006.01)
*B05C 1/00* (2006.01)

(52) U.S. Cl. .... 264/162; 15/230; 15/230.16; 15/230.18; 15/244.1

(58) Field of Classification Search ..... 15/230, 15/230.16, 230.18, 244.1, 244.4; 451/537, 451/527; 264/162
See application file for complete search history.

(56) References Cited

U.S. PATENT DOCUMENTS

| | | | | |
|---|---|---|---|---|
| 2,404,594 | A * | 7/1946 | Pfleumer | 441/1 |
| 3,857,133 | A | 12/1974 | Linenfelser | |
| 4,048,269 | A * | 9/1977 | Wisotzky et al. | 264/413 |
| 4,893,436 | A | 1/1990 | Rich | |
| 4,962,562 | A | 10/1990 | Englund et al. | |
| 5,007,128 | A | 4/1991 | Englund et al. | |
| 5,185,964 | A | 2/1993 | Englund et al. | |
| 5,396,737 | A | 3/1995 | Englund et al. | |
| 6,371,842 | B1 * | 4/2002 | Romero | 451/540 |
| 6,422,926 | B1 * | 7/2002 | McLain et al. | 451/63 |
| D473,685 | S | 4/2003 | McLain et al. | |
| 6,929,539 | B2 * | 8/2005 | Schutz et al. | 451/534 |
| 2003/0049995 | A1 | 3/2003 | Schutz et al. | |

FOREIGN PATENT DOCUMENTS

| | | |
|---|---|---|
| EP | 1 458 524 | 9/2004 |
| WO | 9500295 | 1/1995 |
| WO | 9850198 | 11/1998 |

OTHER PUBLICATIONS

International Search Report dated Nov. 13, 2007.

* cited by examiner

*Primary Examiner* — Randall Chin
(74) *Attorney, Agent, or Firm* — Andrus, Sceales, Starke & Sawall, LLP

(57) ABSTRACT

Selected surfaces of a cellular polymeric foam surface finishing pad are heated to cause the surface cells to partially collapse or to fully collapse and glaze over. The selected surfaces may be the planar pad faces or may be formed in one or more depressions formed in the planar faces. The areas of partially collapsed cell structures in the operating face of the pad provide a slow down in the rate of polish or compound absorption, increasing the effectiveness of the finishing process. The fully collapsed cell glazed surface on the rear attachment face of the pad prevents the migration of moisture through the pad to the pad attachment mechanism.

6 Claims, 4 Drawing Sheets

FOAM BUFFING PAD WITH RANDOM OR STRATEGICALLY PLACED COLLAPSED CELL STRUCTURES

CROSS REFERENCE TO RELATED APPLICATIONS

This application claims priority from U.S. Provisional Application Ser. No. 60/796,457, filed May 1, 2006.

BACKGROUND OF THE INVENTION

Foam buffing and finishing pads are typically made from a polymeric foam material, such as open cell polyurethane foam.

Conventional foam pads have tendency to absorb the water or petroleum-based polish or compound that is used in conjunction with the foam pad to accomplish the task of defect removal from painted and non-painted surfaces. This absorption creates a less effective working surface because the polish, which has abrasives in it, is not on the surface where it needs to be to accomplish the finishing task most efficiently.

Migrating water or petroleum-based polish or compound can penetrate the entire buffing pad and reach all the way to the rear attachment face. Here the compound can collect and, in addition to being messy, can clog the hook-and-loop fastening systems by which the pad is attached to the rotary or orbital driving device. It has been found that prior art pad mounting mechanisms do not adequately inhibit the penetration of moisture to the pad attachment face and the attachment device being used.

SUMMARY OF THE INVENTION

In accordance with the present invention, the operating face of a foam buffing, polishing or finishing pad is formed with random or strategically placed areas of partially collapsed foam cell structures. The pads are typically made to be rotary driven by a powered driving device. Rotary operation is intended to include the motion provided by orbital and dual action driving devices. In another embodiment, the rear attachment face of the pad may be similarly treated, but preferably the cells are fully collapsed causing a glazing or felting of the surface. The treated areas create depressions as a result of the collapse of the cells. With a partially collapsed cell structure, the cells are compressed, but still open to some extent. When the cells are fully collapsed, the cells at the surface are completely closed and the surface is virtually impervious. In other words, the surface is fully glazed over or "felted", a term commonly used in the industry.

Adding random or specific depressions of partially collapsed cell structures to the operating face of the pad has several advantages over conventional, well known foam pads, namely, depressions of collapsed cell structures will slow down the rate of polish or compound absorption, thereby increasing the effectiveness of the polish or compound, and at the same time, saving the end user money by not requiring as much polish to perform the task; depressions of collapsed cell structures will break surface tension that constant full faced pads present, lessening the frequency of pad skipping; depressions of collapsed cell structures provide areas for debris commonly found on working surface to collect, thereby presenting a foam pad that will scratch less; depressions of collapsed cell structures, with less surface-to-surface contact, will reduce surface friction, thereby creating less heat which can damage the working surface; depressions of collapsed cell structures can aid in advertising by imprinting a client's logo or name in the surface of pad; and, depressions of collapsed cell structures are not limited to any shape, size or pattern. Specific shapes, depths and patterns will change the performance of the pad.

The depressions of partially collapsed cell structures can be provided in a random orientation or strategically placed on the operating face of the pad. By strategically placing these patterns, as indicated above, advertising or other indicia can be placed on the operating surface of the pad.

The method of the present invention can also be applied to form an impervious surface of fully collapsed cell structures on the rear attachment face of the pad to prevent or substantially preclude the migration of moisture or other carrier liquid all the way through the pad from the front working face.

In accordance with one embodiment of the method of the present invention, the front operating face of a surface finishing pad made of a cellular polymeric foam material is modified by (1) pressing a heated die face having a pattern of protrusions against the operating face to form depressions in selected areas of the operating face, and (2) holding the heated die in contact with the depressions for a time sufficient to cause the cells of the foam material to partially collapse and retain the depressions. The depressions may be formed in a pattern selected to provide a visually perceptible indicia or in a random pattern. A preferred polymer foam material is open cell polyurethane.

In another embodiment of the present invention, the rear attachment face of a surface finishing pad, using the same or a similar cellular polymer foam material, can be modified by applying the steps of (1) forming a generally planar attachment face on the pad, and (2) heating the attachment face to a temperature and for a time that is sufficient to cause the cells of a part or all of the rear attachment face to collapse, glaze over and form a liquid-impervious surface. The method may include the step of selecting an area on the attachment face that corresponds to the area of a loop scrim connecting piece, and heating the selected area. The method may also include the step of bonding the connecting piece to the selected area on the attachment face. The bonding step preferably comprises heat bonding. In the step of forming the planar attachment face, the attachment face may be depressed to form a recessed face.

In a further embodiment of the present invention, the front operating face and a generally planar rear attachment face of a surface finishing pad may be modified together using the steps of (1) providing a heated die having opposed front and rear halves to engage the respective faces of the pad with the front die half having a pattern of protrusions positioned to engage the front face and the rear mold half having a single planar face adapted to engage the rear pad face, (2) pressing the mold halves against the pad to form a pattern of depressions in the front face and planar contact with the rear face, (3) heating while pressing the protrusions in the pattern to a temperature sufficient to fix the depressions and (4) heating while pressing the single planar die face to a temperature sufficient to cause the cells of the foam material at the surface of the depression to collapse and glaze over, and cause the cells of the foam material at the surface of the depressions to partially collapse. In this method, the heating step is preferably sufficient to provide a surface in the planar face that is impervious to moisture. The method may also include the steps of (1) placing a connecting piece between the rear face of the pad and the rear mold half, and (2) causing the piece to adhere to the surface of the planar rear face.

In accordance with another embodiment of the present invention, a rotary surface finishing pad is made of a cellular polymeric foam material having an operating face and includes depressions that are formed in selected areas of a pad operating face, and the surfaces of the depressions have cells of the foam material that are partially collapsed. In this surface finishing pad, the depressions may be formed in a pattern selected to provide a visually perceptible indicia or formed in a random pattern. The polymeric foam material preferably comprises open cell polyurethane.

In a further embodiment, a rotary surface finishing pad has a generally planar attachment face which face is characterized by having the cells at the surface of the attachment face collapsed and glazed over to form a liquid-impervious surface. The pad may include an area on the attachment face for receipt of a loop scrim connecting piece, and the attachment face is thermoformed. The connecting piece is bonded to the attachment face, the bond preferably comprising a thermal bond. The attachment face is preferably recessed.

In particularly useful embodiment of the rotary surface finishing pad of the present invention, the pad has a front operating face and a generally planar rear attachment face, and the pad further comprises pattern of depressions in the front face and a single planar depression in the rear pad face, the cells at the surfaces of the depressions in the front face being partially collapsed and the cells at the surface of the rear face being collapsed and glazed over. The surface finishing pad of this embodiment preferably includes a rear attachment face that is impervious to moisture. The rear attachment face may be provided with a connecting piece. The front operating face of the pad may be planar or curved. The rear attachment face may be recessed.

DETAILED DESCRIPTION OF THE PREFERRED EMBODIMENT

Figure 2:
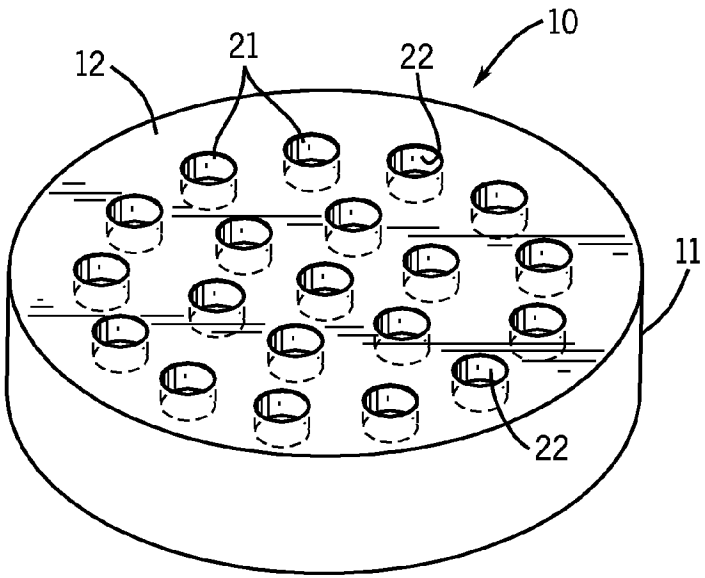
FIG. 2 is a perspective view of a buffing pad formed in the die of FIG. 1.
Figure 4:
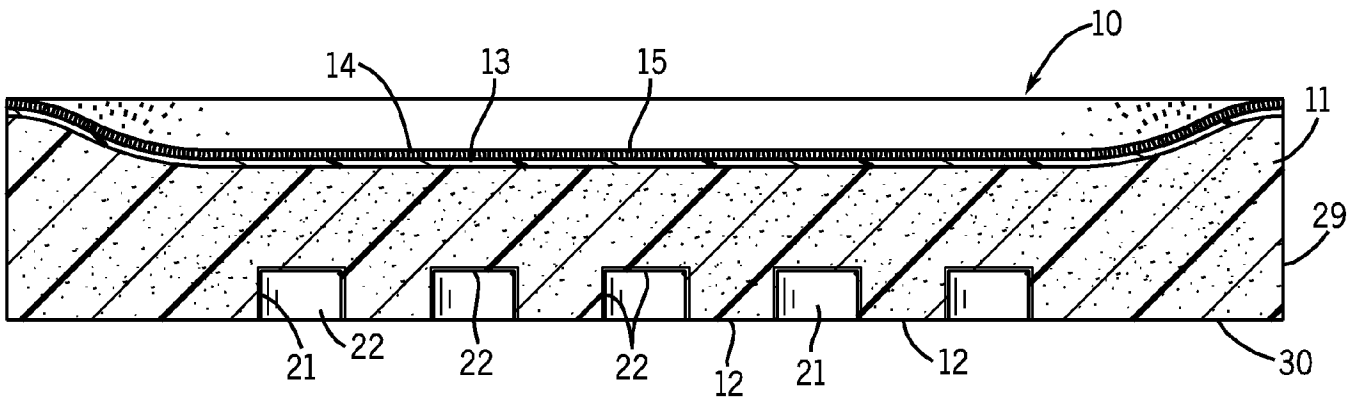
FIG. 4 is a cross section of the pad shown in FIG. 3.

Referring initially to FIGS. 2 and 4, a buffing, polishing or finishing pad 10 is formed from a sheet of polyurethane foam. As is generally well known in the art, the pad 10 is a composite of a foam body 11, having a front operating face 12 and a rear attachment face 13 comprising a sheet of loop scrim 14 attached by heat sealing to the rear face 13 by an intermediate sheet of polyethylene 15.

Figure 1:
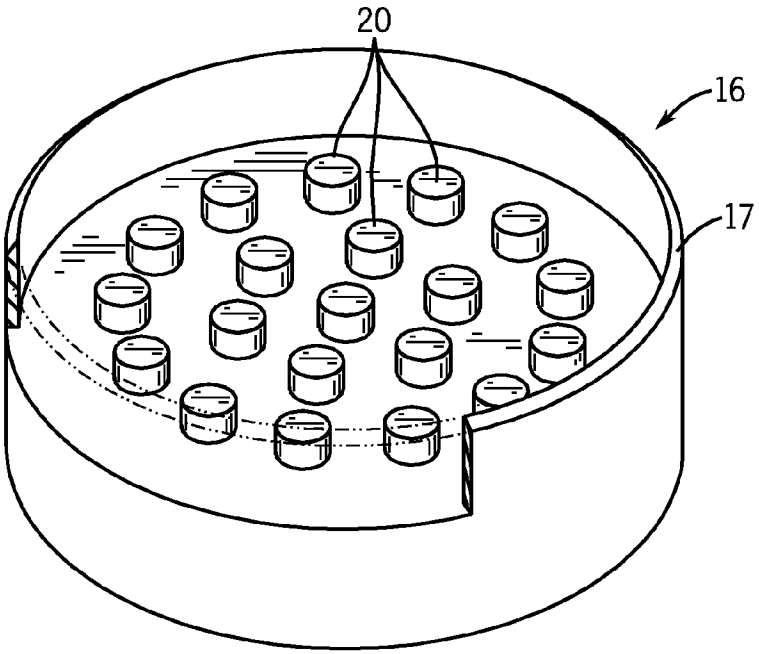
FIG. 1 is a generally schematic representation of the face of a die half in which a buffing pad of the present invention may be formed.
Figure 3:
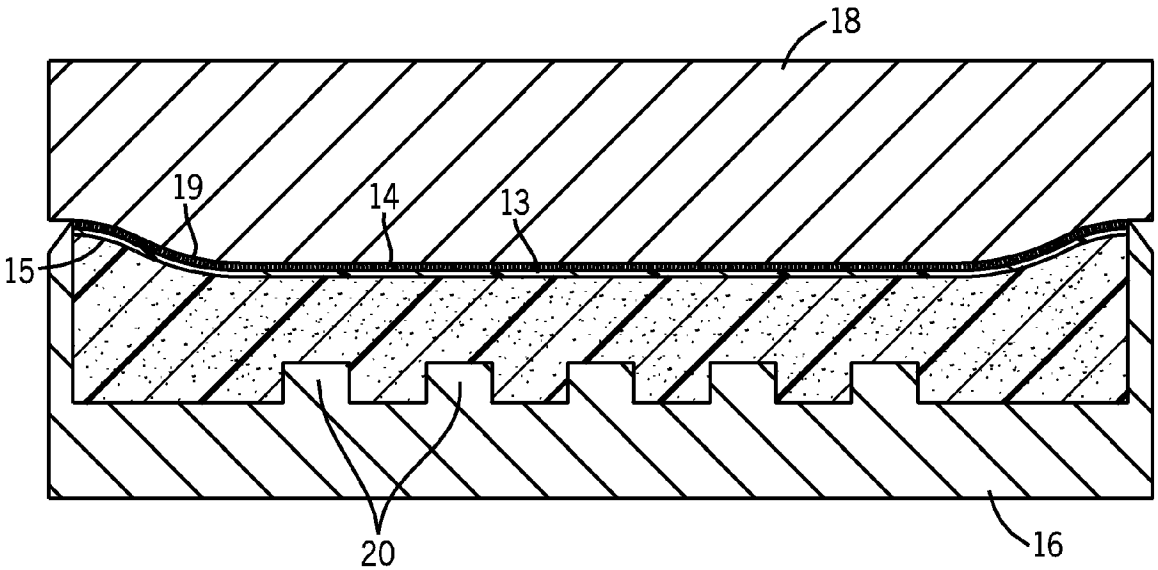
FIG. 3 is a cross section through a two-part forming die showing a buffing pad of the present invention formed with a typical composite construction.

The die from which the pad is formed includes a front die half 16 (FIG. 1) having a recessed interior surrounded by a peripheral knife edge 17 to cut the foam body from a sheet of polyurethane foam. A rear die half 18 may include a slightly convex protruding surface 19 that forms a shallow dished rear attachment face 13 on the pad 10. The attachment face could also be flat or planar. The loop scrim 14 on the rear face 13 is intended to be attached to a hook scrim sheet (not shown) comprising the other half of a conventional hook and loop fastening system. The hook scrim sheet is typically mounted on a rigid or semi-rigid backing plate attached to and driven by a rotary or an orbital drive apparatus. In the pad treating process of the present invention, one or both of the die halves 16 and 18 may be heated to a temperature to soften the polyethylene sheet 15 sufficiently to securely attach the loop scrim 14 to the rear face 13 of the pad body 11. However, the foam body 11 cannot be heated so high as to cause the operating face 12 to glaze over (or "felt") and seal the open cell structure.

In accordance with one embodiment of the present invention, the front die half 16 is provided with upstanding protrusions 20 which penetrate into the foam body 11 in the treating process to form depressions 21 in the operating face 12 of the pad. The die including the protrusions 20 is heated to a sufficient temperature to cause the cell structure of the foam surfaces in contact with the protrusions to partially collapse, yet still define a somewhat open, but more restricted cell structure on the surfaces 22 of the depressions. The temperature to which the front die half 16 is heated is low enough to prevent cell collapse of the surface defining the operating face 12. However, because of the increased pressure with which the protrusions penetrate into the foam body, if the die half 16 is held at temperature for a sufficient time, the foam cells in the surfaces of the depressions 21 will partially collapse. Preferably, however, the surfaces of the recesses 21 are not permitted to completely glaze over and become impervious.

The protrusions 20 and depressions 21 formed by the protrusions are of cylindrical shape, but any convenient shape may be utilized. Also, the size of the depressions 21 can be varied considerably. In addition, the protrusions 20 may be arranged in a pattern that spells a name, message or other indicia in the operating face 12 of the pad. Such strategically placed indicia will still permit the pad to function to provide the desired result as summarized above.

A multi-cavity die can be used to form multiple pads at one time. In addition, pads with other types of backing material different than the loop scrim 14 may also be used. The polyethylene sealing sheet 15, though preferable, can also be made of other materials.

In an alternate method for making finishing pads utilizing the features of this invention, the depressions 21 of collapsed foam cell structures may be formed in a large sheet of foam. The depressions 21 may be formed randomly or in a specific, strategically placed pattern, as indicated above. The foam pads 10 may then be cut or stamped from the sheet, using any convenient method known in the art. The required backing materials are then affixed to the rear face of the pads in the same manner indicated above.

The pad 10 shown in FIG. 4 is cut in the die half 16 as a generally cylindrical edge face 29. If desired, in a subsequent operation, the edge face 29 may be cut or abraded away to form a rounded outer edge 30 as shown. Alternately, in an embodiment not shown, the pad could be provided with a curved operating face by using a curved die having a curved front half and a correspondingly curved rear half to shape and attach the polyethylene sheet 15.

Figure 5:
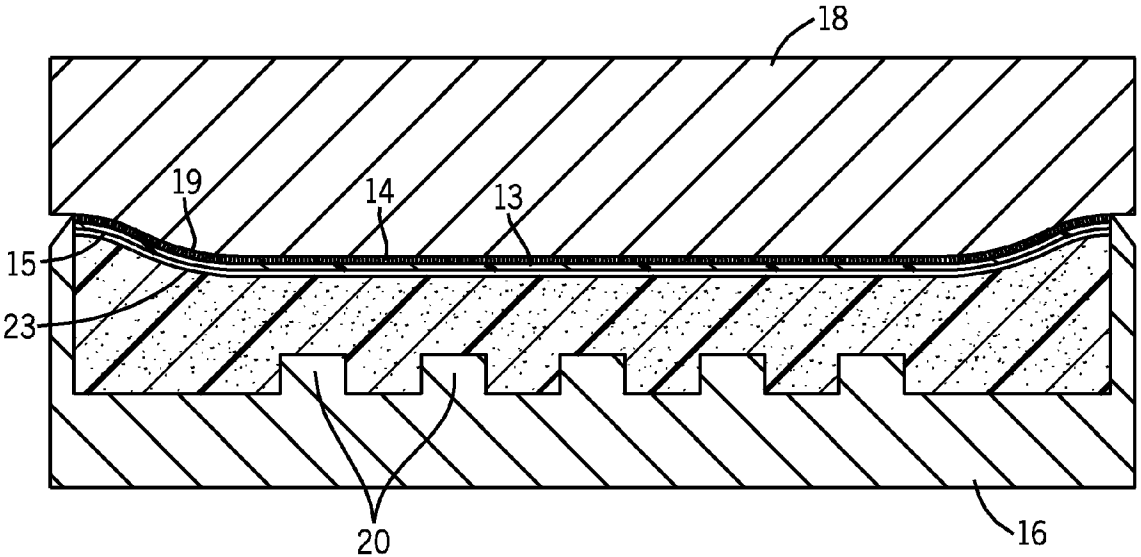
FIG. 5 is a cross section through a two-part forming die showing a buffing pad also having the rear attachment face formed in accordance with another embodiment of the invention.
Figure 6:
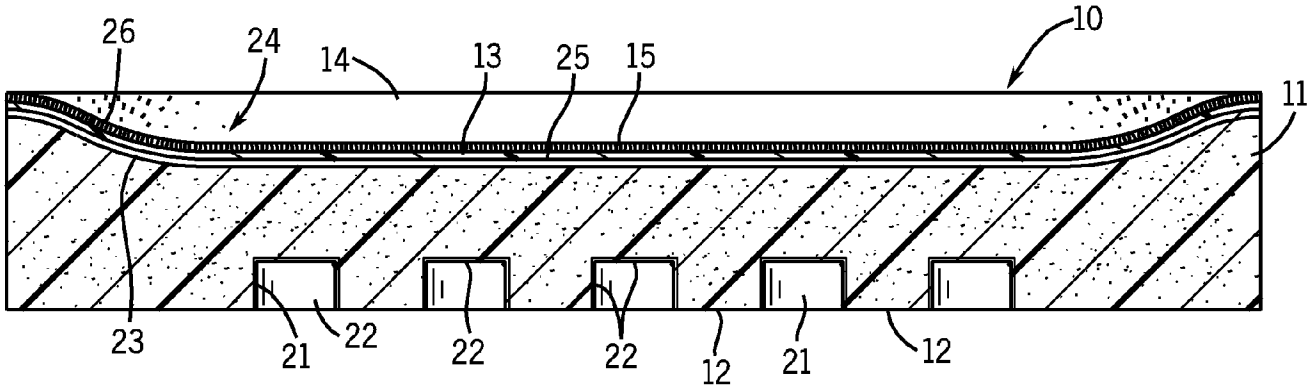
FIG. 6 is a cross section through the pad shown in FIG. 5.

In accordance with another embodiment of the invention, as is shown in FIGS. 5 and 6, the rear attachment face 13 of the foam body 11 has at least a portion of the attachment face treated to cause an area or areas of fully collapsed cell structures, resulting in a surface that is glazed over and impervious to the migration of moisture or other liquid. It is well known that open cell polymeric foam pads absorb water (or petroleum solvent) from the finishing compound being used. The moisture may migrate all the way to the rear face of the pad and may carry with it microfine particles of finishing compound. The result is that the layer of loop scrim 14 and the corresponding sheet of hook scrim (not shown) become wet and contaminated with finishing compound. The result is not only messy, but may interfere with proper attachment of the pad to the rotary driver. The polyethylene sheet 15 by which the loop scrim 14 is attached to the rear face 13 of the pad is not generally impervious to moisture and will not prevent the migration of moisture past that layer.

However, it has been found that by heating the rear attachment face 13 of the pad to a high enough temperature and for a sufficient time, the cell structure on the rear attachment face can also be caused to collapse and glaze over. If properly treated, the glazed rear face 23 can be made completely impervious to the migration of moisture and finishing compound.

Referring particularly to FIG. 5, the glazed rear face 23 may be most conveniently formed in the die and, simultaneously, the rear face of the pad may be formed with the desired shallow depression 24 having a generally planar attachment face 25. The peripheral edge 26 of the pad is turned up and permanently formed to surround the edge of the backing plate (not shown) when the pad is being used. This turned up edge protects the surface being finishing from contact with the hard edge of the backing plate.

As shown in FIG. 6, the pad 10 may be formed with partially collapsed cell structures on the surfaces 22 in the depressions 21 of the operating face 12 and the glazed rear face 23 on the rear attachment face 13. With common types of open cell polyurethane foam, a treating temperature in the range of about 345° F. to 450° F. applied for about 8 to 20 seconds, is sufficient to form impervious or semi-pervious glazed surfaces. With the wide variety of polymeric foam types available, treatment temperatures and times will vary considerably.

There are a number of benefits in treating the front operating face 12 of the pad to provide depressed areas of partially collapsed cell structures, as briefly discussed above. The partially collapsed cells on the surfaces 22 of the depressions 21 result in cell structures that are smaller than the fully open cells of the untreated foam material, but the cells are still open to some extent. As a result, the surfaces 22 of partially collapsed cells slow the rate of absorption of finishing compound into the pad. Finishing compound is thus held in the pockets or depressions 21 where it can continue to be available for the finishing task.

Figure 7:
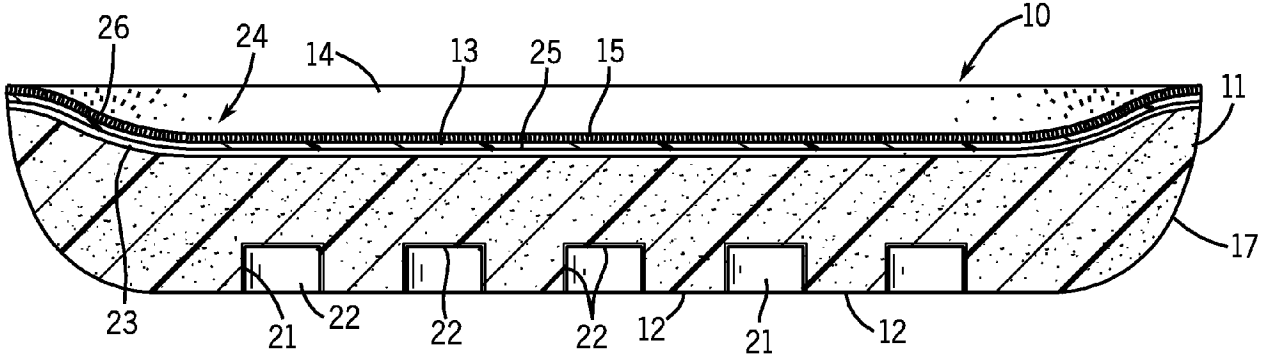
FIG. 7 is a cross section of the pad shown in FIG. 6 after the peripheral edges are rounded.

Because the partially collapsed cells at the surfaces of the depressions 21 are harder than the untreated foam of the remainder of the pad, the partially collapsed cell surfaces 22 could scratch the surface being finished. However, referring particularly to FIG. 7, it has been found that, in use, as the pad face 12 is pressed against the surface 27 being finished, the softer foam surrounding the depressions 21 tends to be forced around the depressions, as shown at 28. As a result, the harder and stiffer surfaces 22 of collapsed cell structures actually recede into the body 11 of the pad, as also shown in FIG. 7. However, the depressions do not become closed off and, as a result, the finishing compound carried in the recesses remains available for the finishing operation and, because surfaces 22 of the depressions are more impervious, absorption of finishing compound into the foam body is reduced.

Figure 8:
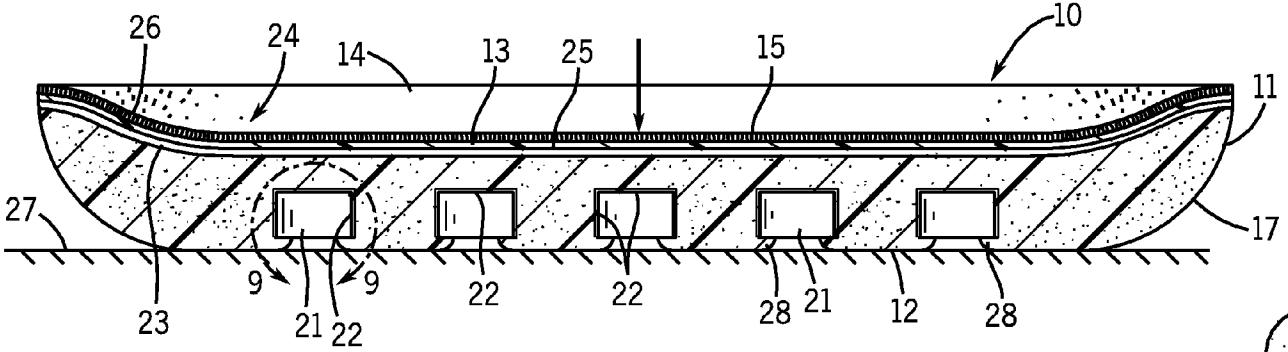
FIG. 8 is a cross section view similar to FIG. 6 showing the compression of the pad operating face in use.
Figure 9:
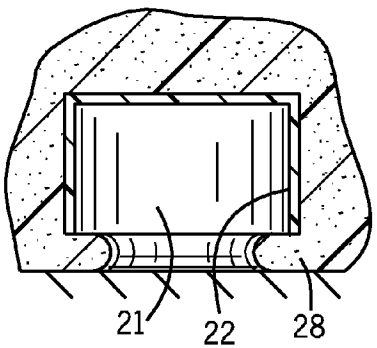
FIG. 9 is an enlarged detail taken on line 9-9 of FIG. 8.

By comparison, a well known polyurethane foam finishing pad has a convoluted surface, but of uniform cell structure. The convolutions theoretically provide pockets in which finishing compound may be retained to enhance the finishing process. However, these pads have a uniform open cell structure and the operating face of the pad actually flattens completely against the surface being worked on as pressure is applied to the pad. In addition, completely open cell structure does not inhibit the migration of finishing compound into the pad. The pad of the subject invention, as shown in FIG. 8, will not completely flatten when pressed against the surface 27 being worked on and will hold the polish or other finishing compound in the depressions 21 where it is continuously available for its intended purpose.

I claim:

1. A method for modifying the operating face of a rotary surface finishing pad made of an open cell polymeric foam material, comprising the steps of:

(1) pressing a heated die face having a pattern of protrusions against the operating face to form depressions in selected areas of the operating face, each of said depressions having a bottom surface and a side surface, the depressions surrounded and enclosed by the surface of the operating face; and (2) holding the die in contact with the depressions for a time sufficient to cause the cells of the foam material at the surface of the depressions to partially collapse and retain the depressions without affecting the cell structure of the surrounding surface of the operating face.

2. The method as set forth in claim 1 wherein the depressions are formed in a pattern selected to provide a visually perceptible indicia.

3. The method as set forth in claim 1 wherein the depressions are formed in a random pattern.

4. A rotary surface finishing pad made of an open cell polymeric foam material, the pad having a front operating face and a generally planar rear attachment face, the pad comprising:

the front operating face having a pattern of depressions each enclosed by the surface of the operating face; and the cells at the surfaces of the depressions being partially collapsed and surrounded by uncollapsed foam material of the operating face;

wherein the front operating face is curved.

5. The surface finishing pad as set forth in claim 4 wherein the rear face is recessed.

6. A rotary surface finishing pad made of an open cell polymeric foam material, the pad having a front operating face and a generally planar rear attachment face, the pad comprising:

the front operating face having a pattern of depressions each enclosed by the surface of the operating face; and the cells at the surfaces of the depressions being partially collapsed and surrounded by uncollapsed foam material of the operating face;

wherein the rear attachment face is recessed.

* * * * *